US008985642B2

(12) United States Patent
Romagnoli

(10) Patent No.: US 8,985,642 B2
(45) Date of Patent: Mar. 24, 2015

(54) METHOD FOR APPLYING A COMPONENT OF A PACKAGE FOR A SUBSTANCE FOR INFUSION

(75) Inventor: Andrea Romagnoli, San Lazzaro di Savena (IT)

(73) Assignee: Tecnomeccanica S.R.L., Bologna (IT)

( * ) Notice: Subject to any disclaimer, the term of this patent is extended or adjusted under 35 U.S.C. 154(b) by 93 days.

(21) Appl. No.: 13/818,803

(22) PCT Filed: Jul. 11, 2011

(86) PCT No.: PCT/IB2011/053089

§ 371 (c)(1),
(2), (4) Date: Feb. 25, 2013

(87) PCT Pub. No.: WO2012/042398

PCT Pub. Date: Apr. 5, 2012

(65) Prior Publication Data

US 2013/0181447 A1 Jul. 18, 2013

(30) Foreign Application Priority Data

Sep. 30, 2010 (IT) ..... BO2010A0588

(51) Int. Cl.
*B65B 29/04* (2006.01)
*B65H 69/04* (2006.01)
*B65D 85/812* (2006.01)

(52) U.S. Cl.
CPC ..... *B65H 69/04* (2013.01); *B65B 29/04* (2013.01); *B65D 85/812* (2013.01)
USPC ..... 289/1.5; 289/16

(58) Field of Classification Search
CPC ..... B65B 29/02; B65B 29/04
USPC ..... 289/1.5, 16; 493/226, 375, 376; 53/413
See application file for complete search history.

(56) References Cited

U.S. PATENT DOCUMENTS

| | | | | |
|---|---|---|---|---|
| 5,399,224 | A | 3/1995 | Vernon | |
| 5,657,712 | A * | 8/1997 | Romagnoli | 112/475.08 |
| 5,873,216 | A | 2/1999 | Appelbe | |
| 6,206,256 | B1 * | 3/2001 | Marzocchi | 223/102 |
| 6,216,620 | B1 * | 4/2001 | Shepard | 112/475.17 |
| 6,343,558 | B1 * | 2/2002 | Shepard | 112/475.17 |
| 6,499,273 | B1 * | 12/2002 | Marzocchi | 53/413 |
| 6,746,699 | B2 * | 6/2004 | Lohrey et al. | 426/83 |
| 7,264,282 | B2 * | 9/2007 | Lambertz et al. | 289/1.5 |

(Continued)

FOREIGN PATENT DOCUMENTS

GB 450703 2/1999

*Primary Examiner* — Shaun R Hurley
(74) *Attorney, Agent, or Firm* — Themis Law

(57) ABSTRACT

A method for applying a component of a package for a substance for infusion having a filter bag for containing a substance and a pickup tag for manually picking up the filter bag includes a method for knotting a string to at least one of the components, which has the steps of interposing, between a string which is held taut along a first axis and a needle having an open lateral eye and angled transversally to the axis of the string, at least one of the components of the package, the component being angled so that the plane in which it lies is substantially parallel with the axis of the string; hooking the string with a single needle and using a sequence of passes through the plane in which the component lies forming stitching, which knots at least two loops of the string that are linked together one after another; and tightening the stitching to stably knot the string to the one or each component of the package.

17 Claims, 5 Drawing Sheets

(56) References Cited

U.S. PATENT DOCUMENTS

| | | | | |
|---|---|---|---|---|
| 7,401,450 | B2 * | 7/2008 | Lohrey et al. | 53/413 |
| 7,523,595 | B2 * | 4/2009 | Klar | 53/413 |
| 2001/0053400 | A1 | 12/2001 | Lohrey | |
| 2004/0222634 | A1 * | 11/2004 | Lambertz et al. | 289/1.5 |
| 2007/0092606 | A1 * | 4/2007 | Klar | 426/77 |

* cited by examiner

METHOD FOR APPLYING A COMPONENT OF A PACKAGE FOR A SUBSTANCE FOR INFUSION

TECHNICAL FIELD

This invention relates to the packaging of substances for infusion in packages comprising filter bags, containing tea, chamomile, herbal products and the like; pickup tags; and pieces of string which connect the bags and the tags.

More specifically, the invention relates to a method for connecting the bags and tags by knotting the string.

BACKGROUND ART

At present there are various types of prior art filter bags for products for infusion, which contain metered quantities of a substance, and which are designed to be immersed in a container holding boiling liquid at the moment of preparing the infusion.

Such filter bags are usually made from a web of filter material which is subjected to a series of successive folds in such a way as to form a tubular element, inside which metered quantities of product are inserted. The tubular element is then cut into pieces of suitable length, folded in half over themselves and closed at their free ends which, by means of a string, are connected to the pickup tag.

Amongst the various techniques for closing the ends of the bag, closing achieved by folding the end over itself then stitching with a knotted thread has been established for some time now with considerable success. Said technique avoids the addition to the infusion liquid of extraneous agents which are not natural, and which can potentially contaminate the infusion in terms of both health and hygiene, and organoleptic properties, since they may alter the flavor of the infusion.

The technique of connecting by knotting, invented for the filter bag, was then also extended to the pickup tag. This was done mainly to have uniform technology, since it would not strictly be essential, considering that the tag is not normally intended to make contact with the infusion.

A critical aspect for all of the prior art solutions involving connection by knotting is obtaining: on one hand, suitable intensity of the force for tightening the connection; and on the other hand, stably maintaining said tightened condition even when the bag remains in infusion in the boiling liquid for a relatively long time.

Indeed, loosening of the knot may prove particularly critical, during immersion of the bag, both due to the possibility of losing control of it if it accidentally becomes disconnected from the string connecting it to the pickup tag, and because of the possibility of causing the dispersion, in the infusion liquid, of the leaves of the essence contained, since the knot connecting the pickup string to the bag often also allows simultaneous sealing of the bag.

Amongst the various systems for packaging with a knotted string, one prior art solution involves basically forming the connection by creating a single loop wound on itself with one or more full turns about its own axis before being passed through by a portion of the string which, together with the loop, contributes to forming a connecting knot.

When the knot is tightened, the torsion previously imparted to the loop and the winding of the string on itself caused by it generate a friction between the various parts of the string which is such that it prevents, in package use conditions, backward movement of the portion of string relative to the loop, thus guaranteeing that the secured condition imparted by the knot is stably maintained.

Making such a knot, whose design is relatively simple, in actual production with high speed automated machinery, proved quite laborious. It is done using machines having rather complex construction which use needles which have a particular shape and special operations, interacting with a set of auxiliary elements whose shape is equally specific and dedicated.

Due to said complexity, such machines are quite expensive. Even the cost of operating these machines is high. The needles, which are in themselves expensive, are subject to rapid deterioration due to wear, meaning that they have to be substituted regularly. The high level of friction created in the string of the knot during tightening is one of the main causes of said rapid wear on the needles.

U.S. patent application 2001/0053400 to Lohrey et al. discloses an infusion bag, especially for tea, which has a top part with folded down corners and a middle part folded over it, to which a string with two free ends is attached that goes from one side of the top part through a hole in the folded down parts forming a loop on the other side of the top part and comes back, so that the two free ends are drawn up through the loop laid over the top edge of the infusion bag and pulled to form a knot. Two holes are made in the top part at a lateral distance next to one another, on the left and right of the longitudinal axis of the bag. Each hole goes through a folded down corner and the middle of the top part, and the string forms a loop and one end goes through one hole and the other end through the second hole. The loop is laid over the top edge of the infusion bag and both ends of the string go up through the loop to form a double knot. This patent application also discloses a method of closing an infusion bag.

DISCLOSURE OF THE INVENTION

The main technical purpose of this invention is to devise a knotting method which allows the obtainment of packages with bags and tags which are connected by a knotted string, in automatic machines which are simpler, less expensive and still able to operate at high production speeds, requiring fewer stops for maintenance.

As part of that task, a first aim of the invention is to allow a knotting method in which stabilizing of the knot is only partly achieved by the friction of the string on itself, the remaining part being achieved thanks to friction between the string and the material of which the filter bag and/or tag is made.

In that way, for tightening of the finished knot which is suitable and stable in its entirety during infusion with the bag, knotting during the packaging steps takes place with much less friction from the needles. This allows an increase in the useful life of the needles and a reduction in the corresponding frequency, in time, of production stops needed for their substitution.

Another aim of the invention is to devise a knotting method which can be carried out with needles with a simple geometry and structure, so as to reduce their unit cost.

Another aim of the invention is to obtain a knotting method which can be obtained practically with the needle alone, thus minimizing, or completely eliminating, the presence of auxiliary elements operating in conjunction with the needle.

Another aim of the invention is to obtain a knotting method which allows complete control of the length of the string, so that the length of the end of the string used to make the knot can be minimized.

Such a feature allows a reduction in the quantity of packaging materials, in particular the quantity of string, with economic benefits: first, for production costs, and then for household waste disposal costs relating to the used infusion packages. Considering the high level of daily use around the world of such packages of products, the above-mentioned economic and environmental benefits appear to be significant.

Moreover, minimizing the end part of the knotting string avoids the presence of loose-flying knot ends, which above all in automatic machines operating at high speed could cause interactions between adjacent bags which might interfere with regular movement in the machine.

That provides the obvious advantage of being able to operate at the highest production speeds with a greater safety margin against malfunctions of the production apparatuses.

Minimizing the end part of the knotting string also allows packages which are more attractive, being particularly pleasant to look at when the bags are intended for packaging without individual outer envelopes.

Yet another aim of the invention is to provide a method in which it is possible to selectively angle the end part of the knot string.

Despite the end part of the string having a minimum length, this allows better hiding of the end part, for example, between the bag and the tag of the finished package.

Accordingly, this invention achieves those aims with a knotting method comprising the technical features described in one or more of the appended claims.

BRIEF DESCRIPTION OF THE DRAWINGS

The technical features of the invention and its advantages are more apparent from the detailed description which follows, with reference to the accompanying drawings which illustrate a preferred, non-limiting example embodiment of the invention and in which.

DETAILED DESCRIPTION OF THE PREFERRED EMBODIMENTS OF THE INVENTION

Figure 1:
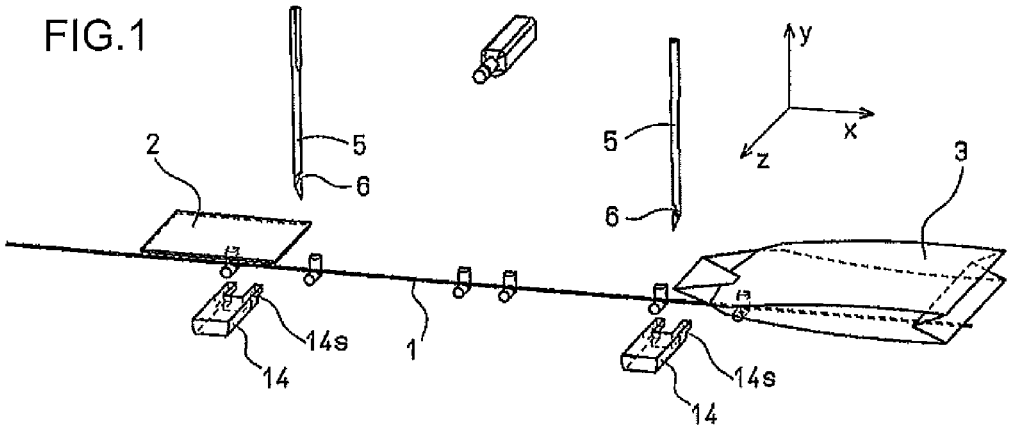
FIGS. 1 to 13 are a schematic view of the sequence of steps of the knotting method according to the invention.

With reference to the accompanying drawings, a method is described for knotting a string 1 to component parts 2 and 3 of a package for a substance for infusion.

The package, not illustrated in the drawings, comprises in particular amongst its component parts a filter bag 3 for containing a metered quantity of the substance for infusion, a tag 2 for picking up the package and holding the bag 3 immersed in water, and a piece of string 1 connecting the bag 3 and the tag 2 by being knotted to them at its free ends.

The knotting method, in particular, consists of a sequence of steps schematically illustrated in FIGS. 1 to 14.

FIG. 1 shows how the initial step of the method consists of pulling the string 1 taut longitudinally to a first axis x, of a Cartesian system x, y, z, of feed of the string 1; positioning, for each of the components 2 and 3 to be connected by knotting, a respective needle 5 with an open lateral eye 6 along respective second axes y parallel with each other and transversal to the first axis x; and placing in a lying plane, interposed between the string 1 and the needles 5, the components 2 and 3 substantially parallel with the string 1.

Figure 2:
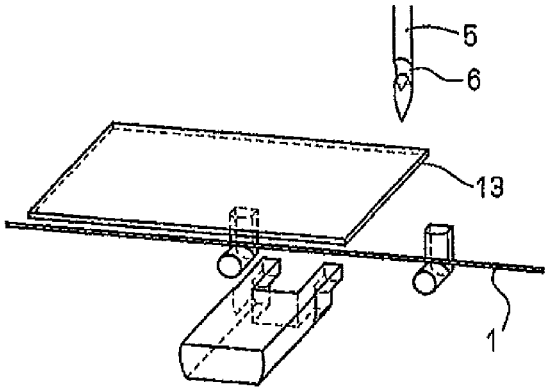
Figure 3:
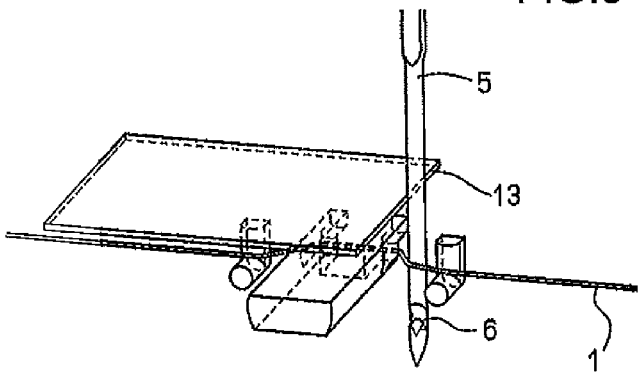

In FIGS. 2 and 3, as in FIGS. 4 to 11, the knotting method is described and illustrated only for one of the components 2 and 3 of the package. This is done solely for the sake of clarity. It shall be understood that what is indicated relative to the component 2 represented may also be considered identically valid for the component 3 of the package, which is not explicitly illustrated.

Having said that, from FIGS. 2 and 3 it can be seen how the knotting method comprises the steps of translating the needle 5 longitudinally to the second axis y and in a first direction of travel (for example, downwards in the drawings) in such a way as to make the eye 6 pass through the plane in which the component 2 and/or 3 lies a first time.

It should be noticed that passing through the plane in which the component lies may occur with, or without, perforation of the material of which the component 2 consists.

FIG. 3 shows an example of such a pass through which occurs without perforation of the component 2 represented by the tag, mainly to achieve the advantage of reduced wear on the needles 5.

Figure 4:
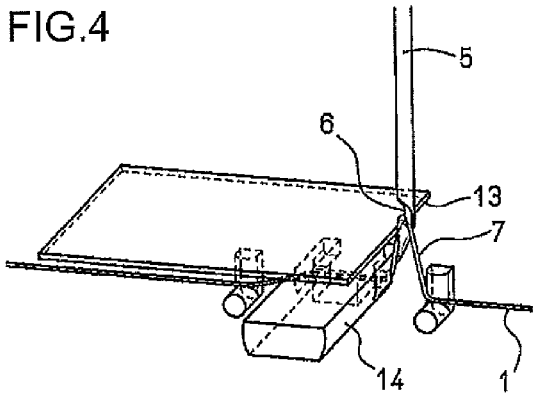

Comparison of FIGS. 3 and 4 reveals that after the needle 5 has reached the end of its stroke (FIG. 3), the needle 5 is again translated along the second axis y, but this time in the second direction of travel (that is to say, upwards in the drawing), in such a way as to hook the string 1 and pull it hooked to the eye 6 through the plane in which the component lies for a second time, without perforation of the material, forming a first loop 7 with the string 1 (FIG. 4).

Once the first loop 7 has been formed, needle 5 (FIG. 5) is translated parallel with itself, and parallel with the first axis x and in a first direction of travel along it (to the left in the drawing) remaining on one side of the component 2. This allows the first loop 7 to be folded and extended longitudinally to the plane in which the component 2 lies, keeping it constantly engaged with the needle 5.

Figure 5:
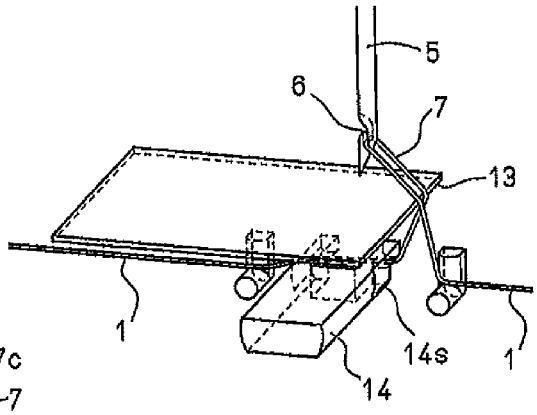
Figure 6:
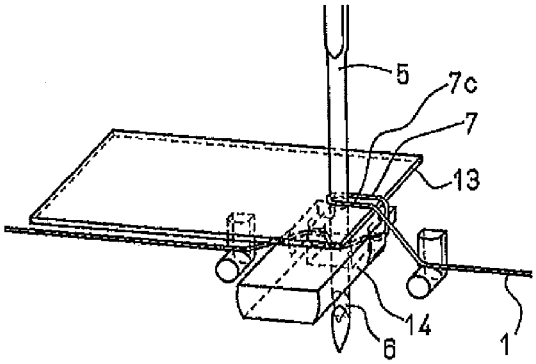

Comparison of FIGS. 5 and 6 shows how the needle 5 is then again translated parallel with the second axis y and in the first direction of travel, so as to make the eye 6 pass through the plane in which the respective component 2 and 3 lies a third time, with the first loop 7 still engaged with the needle 5.

Figure 7:
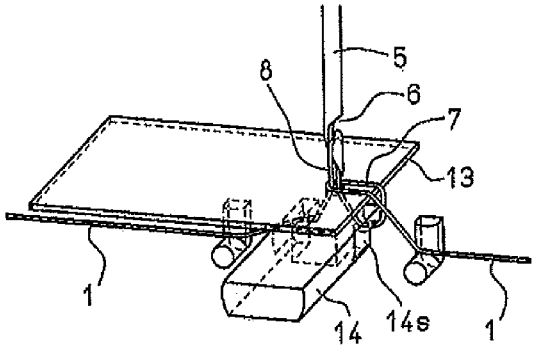

The translation of the needle 5 is then inverted. The needle 5 is again translated along the second axis y and in the second direction of travel, in such a way that the eye 6 hooks the string 1 positioned behind the plane in which the component lies, then pulls it through the plane again (FIG. 7). During that movement, the first loop 7 is constantly retained by the needle 5 until the eye 6 of the needle 5 passes through the plane a fourth time with a second loop 8 hooked to it. From this moment onwards the loop 8 intersects the first loop 7 and, linking with it, secures it to the component 2.

Figure 8:
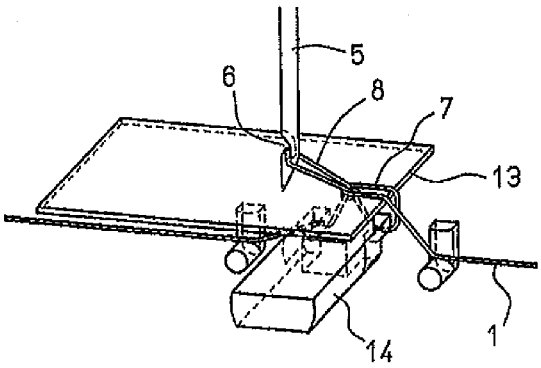

FIG. 8 shows how the method continues with the further step of again translating the needle 5 parallel with itself, and parallel with the first axis x and in the first direction of travel, in such a way as to correspondingly also fold the second loop 8, extending it longitudinally to the plane in which the component 2 lies and keeping it taut using the needle 5.

Figure 9:
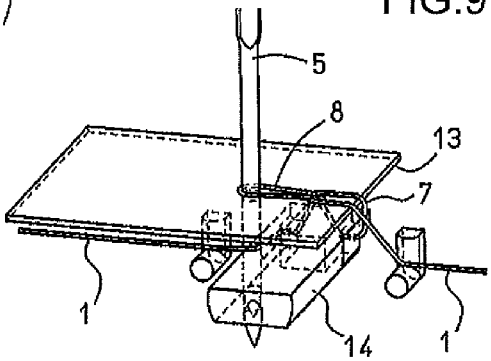
Figure 10:
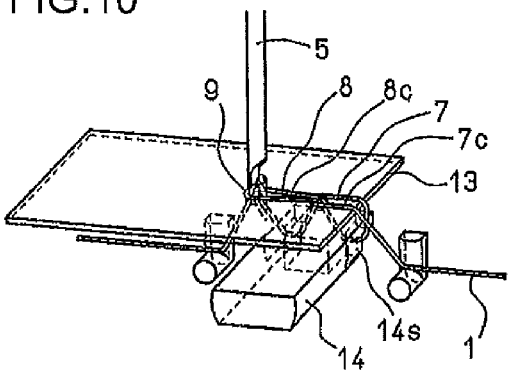

Comparison of FIGS. 8 and 9 shows how the needle 5 is again translated along the second axis y, and in the first direction of travel, in such way as to make the eye 6 pass through the plane in which the component 2 lies a fifth time.

Figure 11:
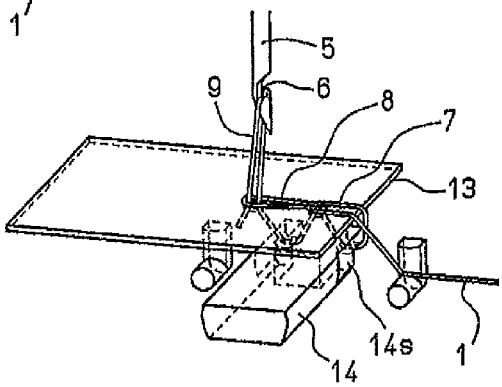

The subsequent step (FIG. 9) sees the needle 5 translate parallel with the second axis y, and in its second direction of travel. Then (FIG. 10) the movement of the needle 5 is inverted and the eye 6 hooks the string 1 positioned behind the component. Then, while the second loop 8 is still engaged with the needle 5, the eye 6 is gradually passed through the plane in which the component 2 lies a sixth time, using the string 1 hooked to the eye 6 to form a third loop 9 which, linking with the second loop 8, is gradually extended along the axis y, as shown in FIG. 11. The third loop 9 is intended to open up, definitively disconnecting the string 1 from the needle 5.

Figure 12:
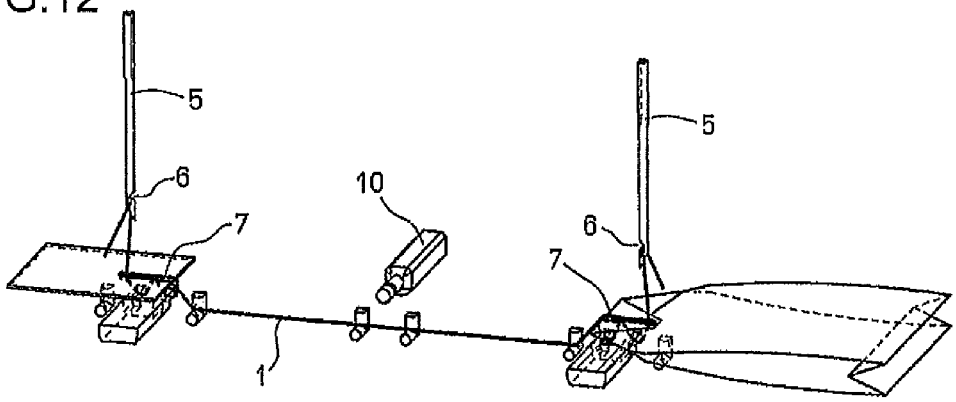
Figure 13:
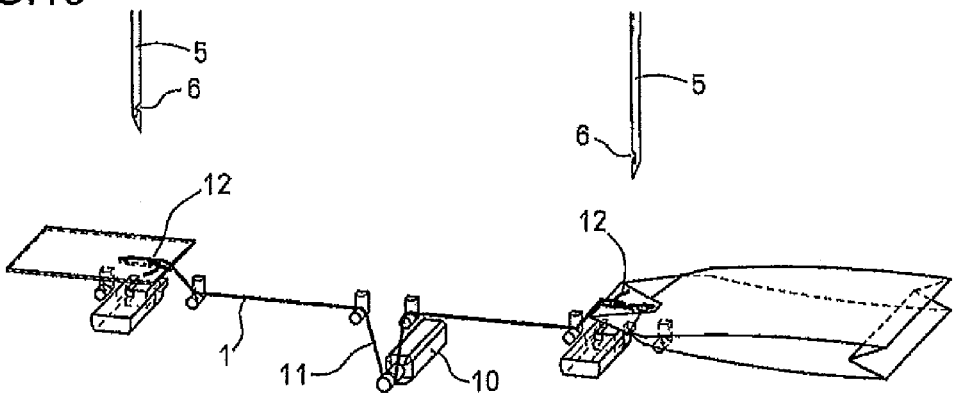
Figure 14:
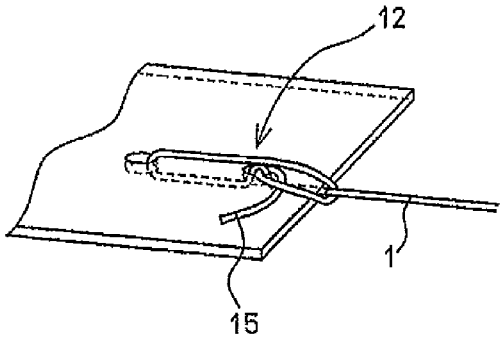
FIG. 14 is an enlarged illustration of a finished, secured knot obtained with the method according to the invention on one of the characteristic component parts of a package for a substance for infusion.

From the above it may be definitively inferred that the method described comprises the formation of a sort of stitching 12 formed by the loops 7, 8, and shown in detail in FIG. 14, which is created solely by the movements of the needle 5. As illustrated in FIGS. 12 and 13 and as can be seen by comparing them, the method continues with the step of pulling the string 1 to secure the loops 7, 8 to both of the components 2 and 3 of the package, definitively tightening the stitching 12 which remains definitively knotted.

Then the cyclical sequence is repeated for another pair of components 2 and 3 starting from the configuration in FIG. 1 again.

Observation of FIG. 12 shows in particular that if the string 1 is in the form of a piece having suitable length, held taut between the two components 2 and 3 of the package being made, it is possible that the step of disconnecting the string 1 from the needles 5 can be performed at the same time as the eye 6 passes through the plane in which the components 2 and 3 of the package lie for the sixth time, and after spontaneous opening of the third loop 9 due to the residual length of the string 1 forming it.

As regards the pulling of the string 1 needed to secure the stitching 12, comparison of FIGS. 12 and 13 shows that pulling of the string 1 is preferably performed with the action of a mobile element 10 which intercepts the string 1 held taut parallel with the first axis x and forms a fourth loop 11 in it, which is angled parallel with the second axis y. The fourth loop 11 is gradually formed in the first direction of the axis y which results in the corresponding securing of the first and second loops 7 and 8 and, consequently, securing of the stitching 12.

FIGS. 1 to 13 illustrating the method clearly show that the steps of translating the needle 5 parallel with itself are performed with a longitudinal extension of the loops 7 and 8 (real pulling) accompanied by a simultaneous contraction of said loops which in practice results in the total occlusion of the openings 7*c* and 8*c* of the loops 7 and 8 aside from the needle 5, when it is positioned through the openings 7*c* and 8*c*.

FIGS. 1 to 13 also show how the steps of translating the needle 5 parallel with itself are also preferably accompanied by a rotation of only the needle 5 about the second axis y. Said rotation—which does not affect the loops 7 and 8—is performed for the minimum angular amplitude absolutely necessary to angle the eye 6 of the needle 5 so that it hooks the string 1 positioned behind the component 2 and 3.

Said angular rotation of the needle 5 is performed with a travel having an amplitude equal to a fraction of a round angle, preferably a rotation of the needle 5, with angular travel limited to a maximum of 180°. Said travel, which does not cause any twisting of the loops 7 and 8, has the advantage of minimizing the friction between the needles 5 and the string 1, with the benefit of extending the useful life of the needles 5.

On the other hand, tightening of the stitching 12 and stably maintaining that tightening when the filter bag 3 is immersed in boiling water are amply guaranteed by the friction and by the retaining actions vice versa activated between the loops 7 and 8 of string 1 and the paper used to make the filter bag 3. The same applies for the tag 2 and the respective loops 7 and 8.

Therefore, it should be noticed that the friction actions are selectively produced, avoiding their activation or keeping them at the minimum intensity during production of the package during which friction would damage the needles 5 by causing them to wear, and instead promoting friction when it is needed during use of the package to make an infusion.

The latter consideration makes clear how the knotting method according to this invention reconciles in an optimum and very advantageous way on one hand package production requirements and on the other hand the requirements for performance by the package during actual use.

FIGS. 1 to 11 also show how formation of the loops 7 and 8—starting with initial wrapping around an edge 13—can use the operating aid of an element 14 designed to act as a contact element for the string subject to the pushing actions applied by the needles 5.

Said contact element 14 has a shoulder 14*s* equipped with a winding profile on which the string 1 rests during folding of the first loop 7. The metric extension of said winding profile may be established in such a way as to allow calibration of the length of the string 1 strictly necessary for knotting.

Therefore, using said property, it is possible to ensure that once the stitching 12 has been secured, the length of the end part 15 of the string 1 is minimized. This avoids the stitching 12 being affected by the presence of free end parts 15 which are too long, which are particularly disadvantageous in functional terms above all in automatic packaging machines operating at high speed, and they are also disadvantageous in aesthetic terms above all for the packages of products for infusion intended to be sold without the application of individual outer envelopes.

Figure 15:
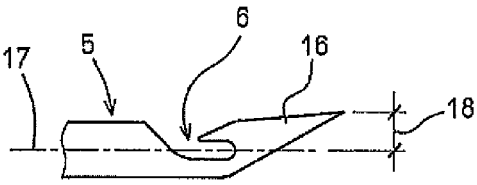
FIG. 15 is an enlarged view of a detail of a needle used in the method according to the invention.

The knotting method according to this invention is perfect for implementing using needles 5 having a very simple design. One example of such needles 5 is shown in FIG. 15, which indicates how the needles 5 have an eccentric tip 16 with a certain offset 18 relative to the axis line 17 of the needle 5 and a lateral open eye 6, located on the same side of the axis line 17 of the needle 5 as the tip.

It should also be noticed that the method is implemented using only a needle 5 which—aside from the merely accessory function of the contact element 14—can perform the entire knotting cycle practically on its own. Practical implementation of said method in an automatic machine will therefore significantly simplify machine construction, with significant implications in terms of costs and reliability.

Figure 16:
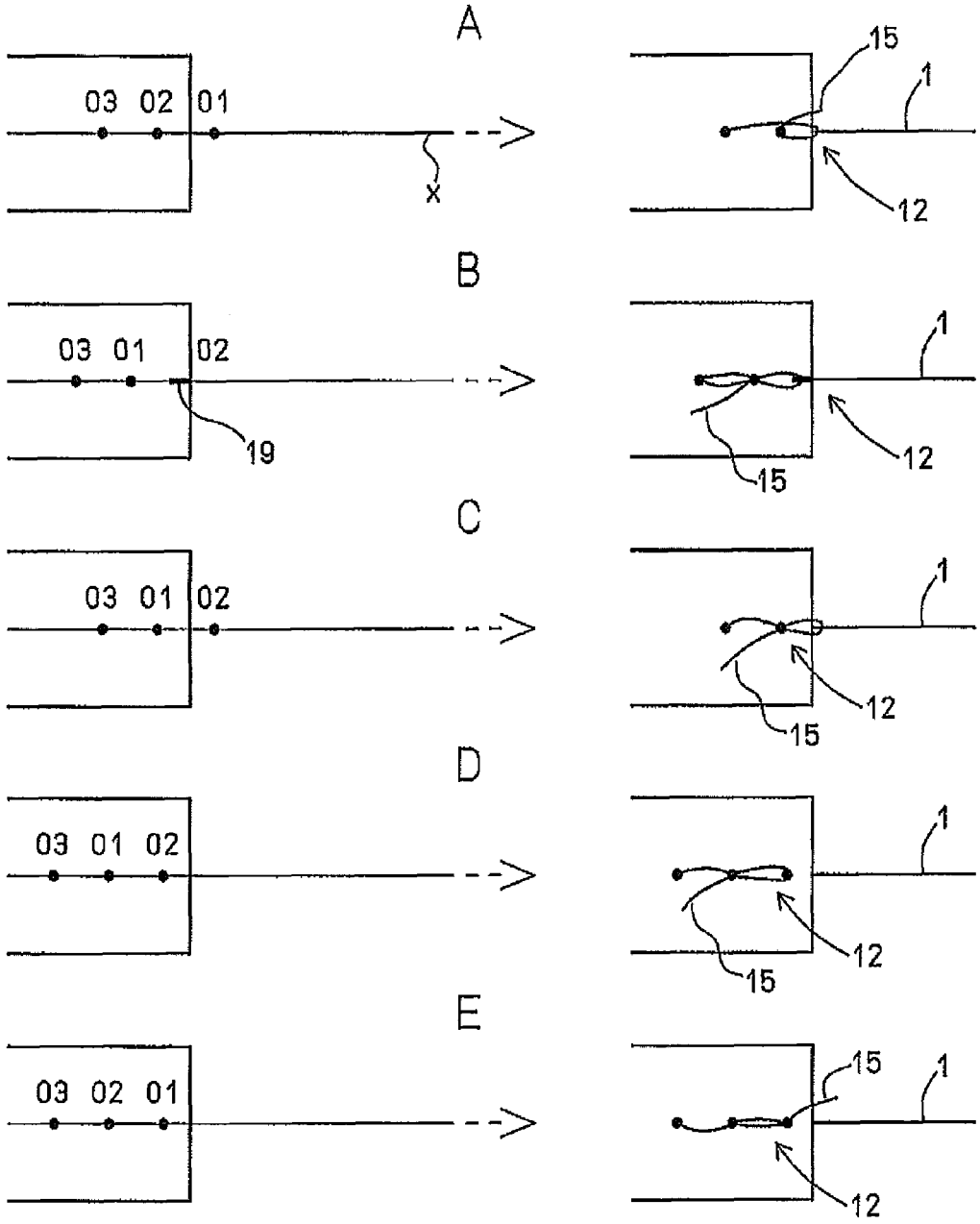
FIG. 16 is a schematic view of several alternative embodiments of the knotting method used to obtain different angles of the knot tail.

FIG. 16 shows—starting from the version labelled A and corresponding to the implementation of the method illustrated in FIGS. 1 to 14—alternative embodiments of the method according to the invention, labelled with the letters B to E.

In versions A to E of FIG. 16 the first, second and third pass of the string 1 through the plane in which the component lies are performed at transit points labelled 01, 02 and 03.

It should be noticed that said points 01, 02 and 03 are consecutive in one direction relative to a predetermined direction of travel of the first axis x. In fact, in versions A and E, the points 01, 02 and 03 are reached, in order, by continuing to travel along the axis x in the same direction (for example, from right to left along that line). The only difference between A and E is the fact that in the former version, the first pass through the plane in which the component lies occurs without perforation of the component 2 (or 3), whilst in version E all of the pass throughs are performed with perforation.

In versions B, C, D of FIG. 16, the first, the second and the third passes through the plane in which the component lies are instead carried out at needle 5 transit points 01, 02 and 03 which are not consecutive in one direction relative to a predetermined direction of travel. It should be noticed that, to go from the transit point 01 to the point 02 the needle 5 translates to the right, the translation instead occurring in the opposite direction during the subsequent movement from the point 02 to the point 03. The only differences between versions B, C and D relate to the fact that in version B, the transit through point 02 may be performed at a notch 19 previously made in the component 2 of the package, for reducing the perforation stress. In version C the transit through point 02 occurs without perforation. Whilst in version D the transit with steps in more than one direction is achieved through all of the points with perforation of the material used to make the components 2 (or 3) of the package.

Depending on the order of execution of the pass-throughs 01, 02 and 03, it is possible to angle the end parts 15 of the stitching 12 in opposite directions as shown on the right in FIG. 16.

Therefore, by selecting the order of execution of the transit points 01, 02 and 03 through the plane in which the components 2 and/or 3 lie, the method allows the desired orientation of the end parts 15, for example to minimize their functional influence in the packaging method and/or to improve the overall look of the package.

Obviously the knotting versions A to E which are all performed in a line, as illustrated in FIG. 16, are a preferable, but not exclusive embodiment of the knotting method. Obviously, the sequence of transit points 01, 02 and 03 may also comprise (in an alternative embodiment not illustrated in the accompanying drawings) distribution of the points 01, 02 and 03, for example at the vertices of a triangle.

The invention described is susceptible of industrial application. The invention may also be modified and adapted in several ways without thereby departing from the scope of the inventive concept. Moreover, all details of the invention may be substituted by technically equivalent elements.

The invention claimed is:

1. A method for applying a component (2; 3) of a package for a substance for infusion comprising components which include a filter bag (3) containing a substance and a pickup tag (2) for manually picking up the filter bag (3), the method comprising a method for knotting a string (1) to at least one of the components (2; 3), the method for knotting the string comprising the steps of:

interposing, between the string (1), which is held taut along a first axis (x), and a needle (5) having an open lateral eye (6) and angled transversally to an axis (x) of the string (1), a component (2; 3) of the package, the component being angled so that a plane in which the component lies is substantially parallel with the axis (x) of the string (1);

hooking the string (1) with a single needle (5) and with a sequence of passes through the plane in which the component (2; 3) lies forming stitching (12), which knots at least two loops (7, 8) of said string (1) which are linked together one after another; and tightening the stitching (12) to stably knot the string (1) to said component or to each component (2; 3) of the package.

2. The method according to claim 1, wherein the step of hooking the string (1) comprises the steps of:

making the eye (6) of the needle (5) pass a first time through the plane in which the component (2; 3) lies, hooking the string (1) and again withdrawing the needle (5) with a second movement through the plane in which the component lies, with the string (1) hooked to the eye (6) in such a way as to form a first loop (7) with the string (1);

translating, in parallel motion along the axis (x) and on one side of the plane in which the at least one of the components lies, the needle (5) engaged with the first loop (7) in such a way as to extend the first loop (7) on the plane in which the component lies;

passing through the plane, in which the component lies, a third time with the eye (6) of the needle (5) while the first loop (7) remains associated with the needle (5), using the eye (6) to hook the string which is behind the plane in which the component lies and then withdrawing the needle (5) so that the needle passes through the plane in which the component lies a fourth time, thus forming a second loop (8) which, when hooked to the eye (6), passes through the plane in which the component lies, intersecting and linking with the first loop (7);

again translating the needle (5) in parallel motion, on one side of the plane in which the component lies and parallel with the axis (x), in such a way as to extend on the plane in which the component lies the second loop (8) which is linked with the first loop (7);

passing through the plane in which the component lies a fifth time with the eye (6) while the second loop (8) remains retained by the needle (5), using the eye (6) to hook the string (1) which is behind the component (2; 3) and again withdrawing the needle (5) by passing through the plane in which the component lies a sixth time, thus using the string (1) hooked to the eye (6) to form a third loop (9) linked to and intersecting the second loop (8);

disconnecting the third loop (9) from the needle (5), forming the stitching (12) with the string (1), said stitching being formed in its entirety solely by the movement of the needle (5); and pulling the string (1) of the stitching (12) in such a way as to render the stitching (12) stably knotted.

3. The method according to claim 1, wherein the steps of the method are carried out simultaneously on the bag (3) and the pickup tag (2).

4. The method according to claim 2, wherein the step of disconnecting the needle (5) from the third loop (9) is performed simultaneously with the eye (6) passing through the plane in which the component (2; 3) lies for the sixth time.

5. The method according to claim 4, wherein the string (1) is prepared in the form of a piece with predetermined length, the length of the piece of string being established to allow a spontaneous opening of the third loop (9) during the passing for the sixth time through the plane in which the component (2; 3) lies.

6. The method according to claim 2, wherein the step of pulling the string (1) is carried out with an action of a mobile element (10) which intercepts the string (1) held taut longitudinally to the first axis (x), forming a fourth loop (11) in it which the string angled longitudinally to a second axis (y), a gradual formation of said fourth loop (11) in a direction of the second axis (y) resulting in a corresponding securing of the first and second loops (7, 8).

7. The method according to claim 2, wherein the steps of translating the needle (5) in parallel motion are carried out at a same time as transversal contraction of the first and second loops (7, 8) which continues until respective openings thereof are closed.

8. The method according to claim 2, wherein the steps of translating the needle (5) in parallel motion are accompanied by a rotation only of the needle (5) about a second axis (y), which is carried out over a minimum angle necessary to angle the eye (6) of the needle (5) in such a way that the needle is positioned to hook the string (1), which is behind the component (2, 3).

9. The method according to claim 8, wherein the rotation of the needle (5) is carried out with a travel whose amplitude is equal to a fraction of a round angle.

10. The method according to claim 2, wherein the first and second passes through the plane in which the component lies by the eye (6) are earned out as the string (1) is wrapped around an edge (13) of the component (2; 3).

11. The method according to claim 10, wherein the string is wrapped around the edge (13) by interposing a rigid contact unit (14) between the component (2, 3) and the string (1).

12. The method according to claim 11, wherein the rigid contact unit (14) has a shoulder (14*s*) with a winding profile whose length is proportionate to a length calibration of an end part (15) of the stitching (12) after securing.

13. The method according to claim 2, wherein first, second and third passes through the plane in which the component lies are carried out at needle (5) transit points (01, 02, 03) through the plane in which the component lies, which are consecutive in one direction relative to a predetermined direction of travel of the first axis (x).

14. The method according to claim 2, wherein first, second and third passes through the plane in which the component lies are carried out at needle (5) transit points (01, 02, 03) through the plane in which the component lies which are consecutive in both directions relative to a predetermined direction of travel of the first axis (x).

15. The method according to claim 2, wherein transit points (01, 02, 03) with passage through the plane in which the component lies are established with a sequence selected according to a final orientation desired for an end part (15) of the stitching (12) used to secure the string (1) to said component or said each component (2; 3).

16. The method according to claim 1, wherein the needle (5) comprises an eccentric tip (16) with an offset (18) relative to an axis line (17) of the needle (5).

17. The method according to claim 16, wherein the needle (5) comprises one eye (6) and one eccentric tip (16) which are positioned on a same side of the axis line (17).

* * * * *